US006190207B1

(12) United States Patent
Wang

(10) Patent No.: US 6,190,207 B1
(45) Date of Patent: Feb. 20, 2001

(54) WATERPROOF SOCKET ADAPTER DESIGN

(76) Inventor: Lien-Sheng Wang, No. 27, 8th Floor-2, Alley 3, Lane 318, 2nd Section, Chong-Sing RD., Chu-Dong, Hsinchu (TW)

( * ) Notice: Under 35 U.S.C. 154(b), the term of this patent shall be extended for 0 days.

(21) Appl. No.: 09/280,519

(22) Filed: Apr. 5, 1999

(51) Int. Cl.[7] ..... H01R 13/68
(52) U.S. Cl. ..... 439/622
(58) Field of Search ..... 439/621, 622; 337/197, 198, 255

(56) References Cited

U.S. PATENT DOCUMENTS

| | | | | |
|---|---|---|---|---|
| 4,904,976 | * | 2/1990 | Liaq | 439/622 |
| 5,154,642 | * | 10/1992 | Chang-Yin | 439/622 |
| 5,482,478 | * | 1/1996 | Liao | 439/622 |
| 5,791,941 | * | 8/1998 | Wang | 439/622 |
| 5,853,301 | * | 12/1998 | Wang | 439/622 |

* cited by examiner

*Primary Examiner*—Gary F. Paumen

(74) *Attorney, Agent, or Firm*—Rabin & Champagne, P.C.

(57) ABSTRACT

An improved waterproof socket adapter which consists of an insert holder, a housing, leaf copper conductors, a cover, a power cable and u shaped copper tabs et cetera, the insert holder has a waterproof partition and a key arranged inside it, and cord profiled grooves with ribs provided behind and between pinholes on its front side; the housing has internal sliding and guide slots provided for fitting a key on the cover and the waterproof partition inside the insert holder respectively, and a front key-way arranged for engaging the key on the insert holder; besides, a bottom gap is provided on the front side of the housing and in its vertical wall there are cord profiled grooves and a key-way provided, the cord profiled grooves have several ribs arranged in them respectively; for the key of the insert holder has its vertical extension integrated with the waterproof partition, two cords of the cable may be separated positively without any short circuit when the insert holder and the housing is assembled together; and the outer insulators of the cords are clamped by the ribs both in the insert holder and the housing so that the power cable will be fixed firmly by the ribs offering an airtight and waterproof design which is able to provide a secure connection and shock resistance even if presence of an eventual foreign force.

11 Claims, 6 Drawing Sheets

WATERPROOF SOCKET ADAPTER DESIGN

FIELD OF THE INVENTION

The present invention relates to an improved waterproof socket adapter design, especially a design which is able to provide a secure connection even if an eventual foreign force is present, and is shock resistant, waterproof has and electric leakage preventing functions.

BACKGROUND OF THE INVENTION

A conventional socket adapter design, as shown in FIG. 1, has two receptacles 111 at proper points within an insert holder 11, and which are provided for copper tabs 21 at ends of a power cable 20 to a power source. The receptacles 111 are separated by a partition 112. The insert holder 11 has pinholes 113 arranged on its front side and there are two passages provided for cords going behind them. The copper tabs 21 of the power cable 20 are placed in position in the insert holder 11, while leaf copper conductors 33 are inserted in recesses 114 arranged in the insert holder 11. Meanwhile, fuses 80 are placed in the receptacles 111, then the insert holder assembly is inserted into the housing 12 to form a socket adapter. However, such a socket adapter design has some shortcomings, such as poor waterproof performance, owing to the fact that here are gaps between the insert holder 11 and the housing 12 and between the cover 13 and the housing 12. Further, if joints 22 of the power cable 20 with the copper tabs 21 are in a poor condition, potential risks of removal of cord(s) and a short circuit will incur Furthermore, the cover 13 is not able to provide a positive waterproof performance. Because there is not any protection at the joints 22 of the power cable 20, power failure or electrical leakage will be encountered due to cord removal or loosing after long periods of use or under an eventual foreign force. Therefore, it is really not an ideal design.

So, a socket adapter design which is able to provide a waterproof function, secure connection, shock resistance and high safety is needed.

SUMMARY OF THE INVENTION

An object of the present invention is to provide an improved socket adapter design, especially a design which is able to provide a secure connection even in the presence of an eventual foreign force, and which is shock resistant, waterproof and has electrical leakage preventing functions.

However, in order to describe the object, characteristics and functions of the present invention in detail, an example of embodiment and relative figures to the present invention are given as follows:

DETAILED DESCRIPTION OF THE INVENTION

Figure 1:
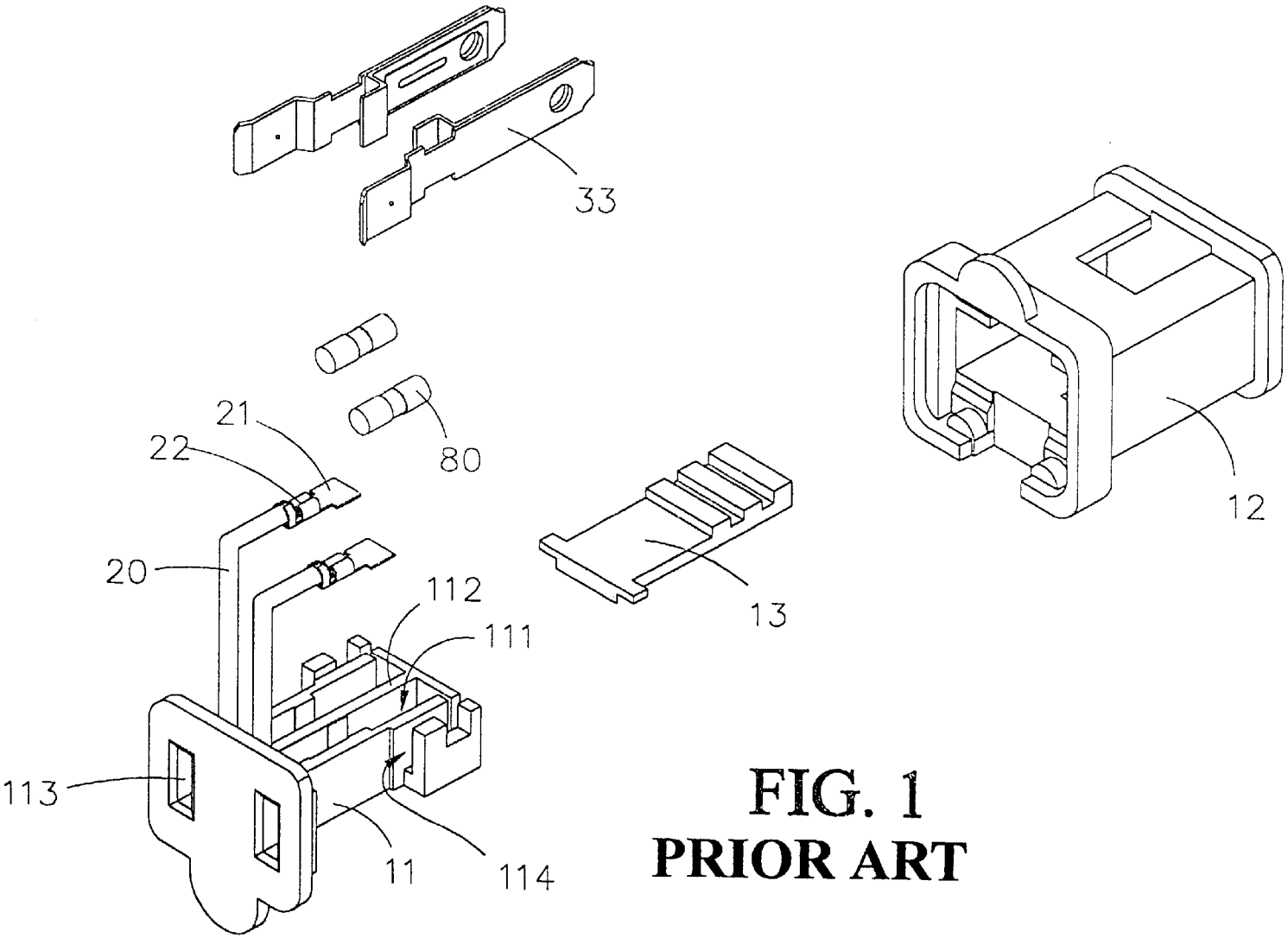
FIG. 1 PRIOR ART
FIG. 1 is a schematic exploded view of a conventional socket adapter design.
Figure 2:
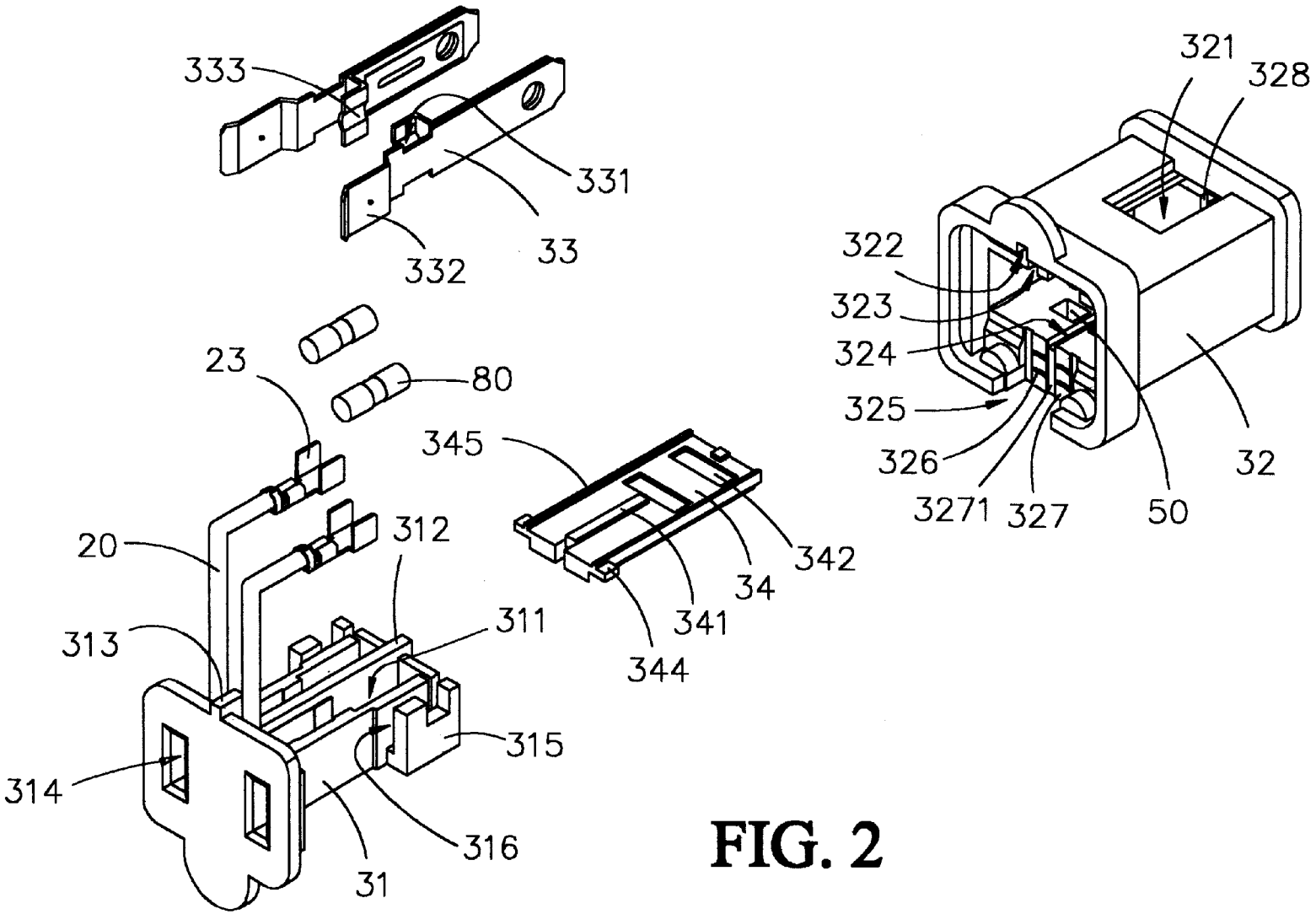
FIG. 2 is a schematic exploded view of the present invention.

FIG. 2 is a schematic exploded view and FIG. 3 is a schematic exploded partially assembled view of the present invention in which an insert holder 31, a housing 32, leaf copper conductors 33, a cover 34, a power cable 20 and u shaped copper tabs 23 are included. The insert holder 31 has two receptacles 311 arranged at proper points inside it for the u shaped copper tabs 23 at ends of the power cable 20. The leaf copper conductors 33 have a contact 332 designed at their ends respectively and correspondingly. The receptacles 311 are separated by a waterproof partition 312, and the waterproof partition has extensions out of its upper, lower and rear side. The insert holder 31 has two side blocks 315 provided correspondingly at its rear between which and the body of the insert holder two recesses 316 are formed for the placement of the leaf copper conductors 33 in them. The leaf copper conductors 33 have at their proper central points an n-shaped recess (projection) 331 provided correspondingly. The conductors can just be placed in the extreme positions respectively in the receptacles 311, and the n shaped recess 331 and the u shaped copper tab 23 which are placed in position may form a room for a fuse 80 that serves as an over current protection. The contact 332 located at the end of the leaf copper conductor 33' after being placed in the insert holder 3' may serve to supply electrical power. The n-shaped recesses 331 have an arched recess 333 respectively and correspondingly arranged for increasing the contacting area with the fuse 80 to avoid electrical spark generated due to poor contacting.

Figure 4B:
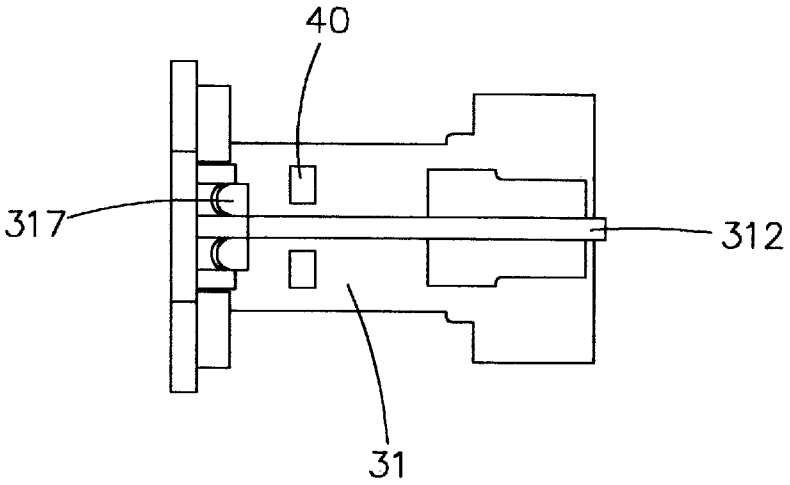
FIG. 4B is a schematic upward view of an insert holder of the present invention.
Figure 4A:
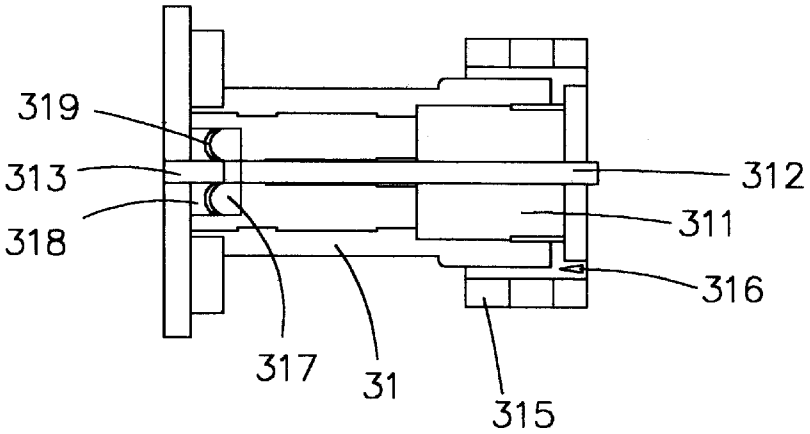
FIG. 4A is a schematic vertical view of an insert holder of the present invention.

Referring to FIG. 4, the insert holder 31 has pinholes 314 provided on the front side for a plug to receive the power supply, and two holes 317 provided in the vertical direction for cords going through behind the pinholes. Additionally, on the front upper edge between the two pinholes 314 of the insert holder 31 a key 313 is provided. Key 313 extends inwards and downwards to be integrated with the waterproof partition 312 for cords separation of the power cable 20 so that a short circuit due to contacting of cords will be prevented. Cord profiled grooves 318 with ribs 319 in them respectively are arranged vertically beside the extension of the key 313.

Figures 3A, 3B:
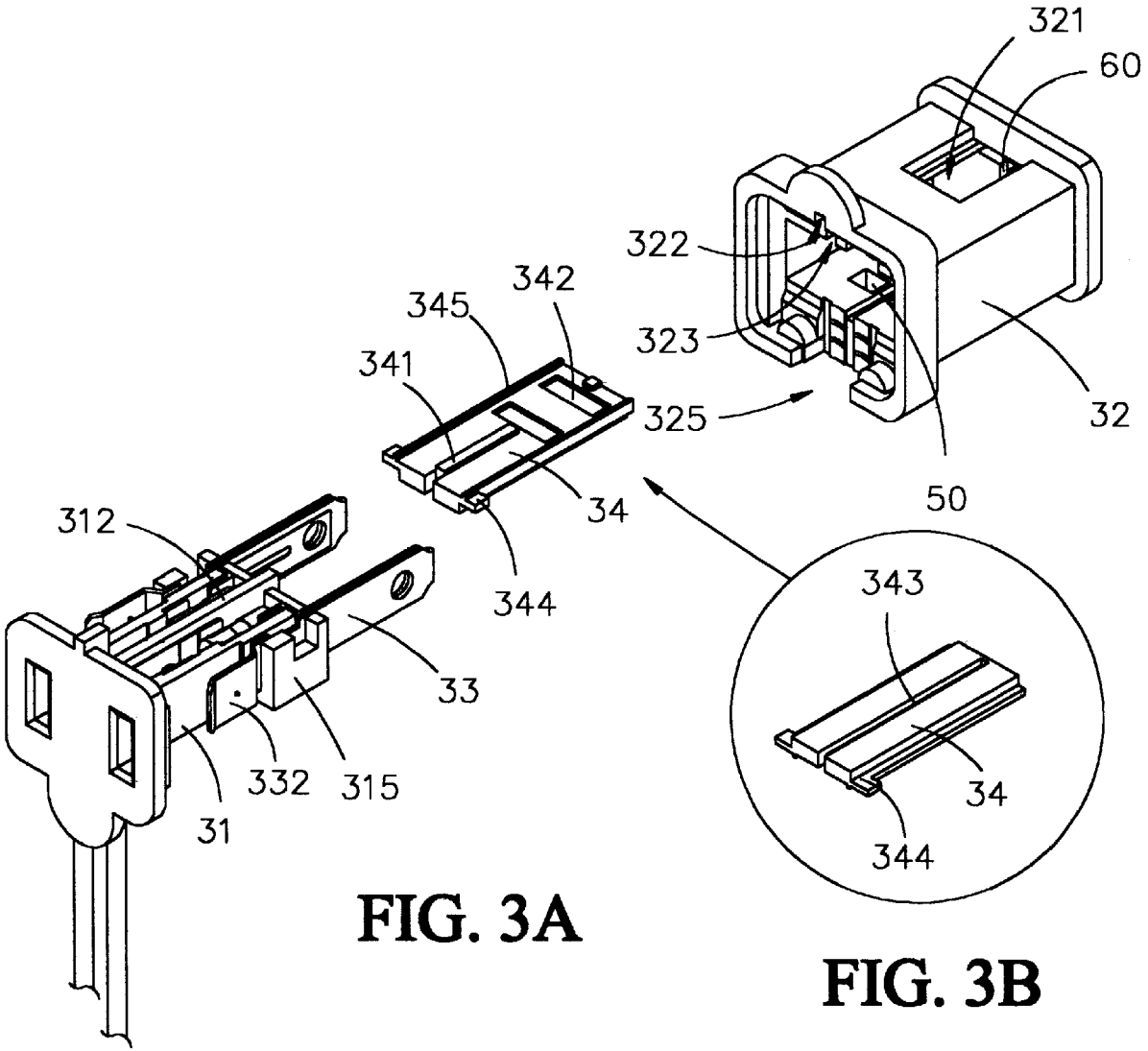
FIG. 3A is a schematic exploded partially assembled view of the present invention.
FIG. 3B is a schematic back side view of a cover of the present invention.

The housing 32 has an exposed. A sliding slot 323 and a guide slot 324 are arranged respectively in its internal upper and lower walls. A key-way 322 is provided in the internal upper wall on the front side for fitting the key 313 of the insert holder 31. On the front side a bottom gap 325 is provided and on its vertical wall there are cord profiled grooves 327 and a key-way 3271 arranged. The cord profiled grooves 327 have several ribs 326 provided in them respectively for clan-ping the power cable 20. The key-way 3271 engages just with the lower key of the insert holder 31. In addition, the cover 34 has a key 341, recesses 342, two lugs 344 and ribs 345 equipped on its top side, and a slot 343 provided on its back side, as shown in FIG. 3B. A window 321 is arranged on the top side of the housing 32 which will be located at the rear for the fuse replacement when the cover 34 is inserted into the housing 32.

Figure 5:
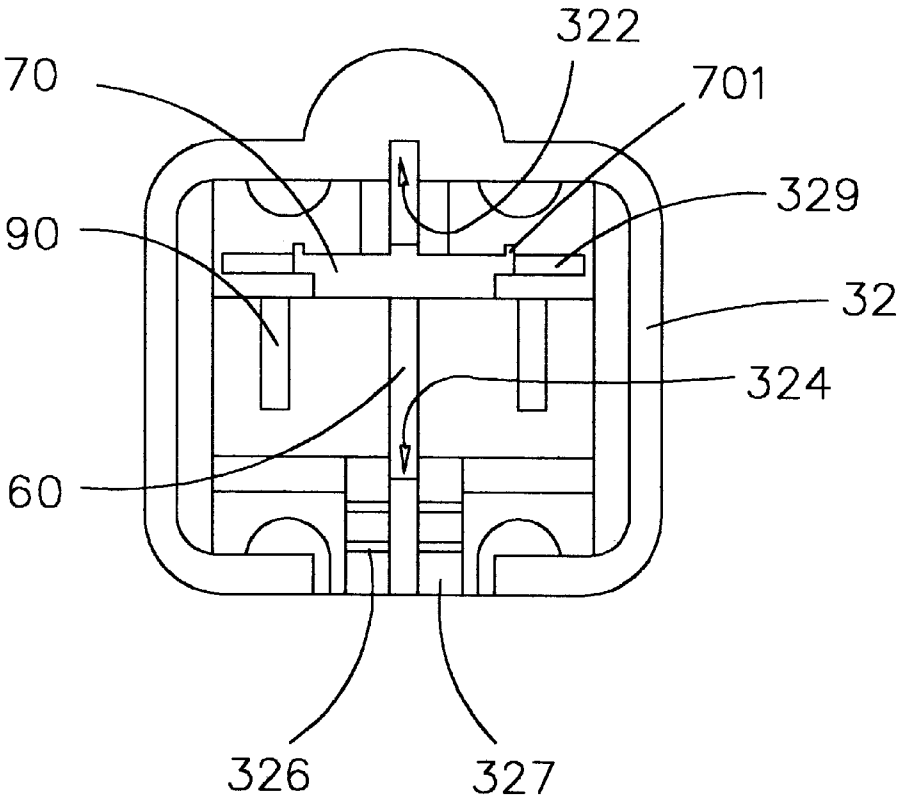
FIG. 5 is a schematic side view of a housing of the present invention.

Referring to FIG. 4 and FIG. 5, in the internal lower wall of the housing 32' two recesses 50 are arranged at proper points for being clicked in by two wedge protrusions 40 which are equipped at proper points on the bottom of the insert holder 31 so that they can be fitted firmly. The housing 32 has a slot 60 provided at the rear inside for containing the rear extension of the waterproof partition 312 of the insert holder 31 so that two power poles will be able to be separated positively. A receptacle 70 is arranged over the slot 60 for receiving the cover 34 and serves as an exposed opening when the cover 34 is opened. The receptacle 70 has a same contour as that of the cover 34, therefore, when the cover 34 is fitted in the insert holder 31 and the housing 32, the ribs 345 on the cover 34 will be just inserted in the slots 701 in the receptacle 70 to offer a positive waterproof function. On both sides of the receptacle 70 there are two sliding slots 329 provided for the lugs 344 on the cover 34 which therefore, may be moved in them, however, the lugs 344 may not get out from the housing 32 because the sliding slots 329 are blocked by the rear wall of the housing 32. Beside the slot 60 there are two outer recesses 90 provided for the leaf copper conductors 33 which are placed in the insert holder 31 to form a plug design.

Before the insert holder 31 is inserted into the housing 32, the u shaped copper tabs 23 on the power cable 20 shall be firmly placed in the receptacles 311 of the insert holder 31. Then, the leaf copper conductors 33 are inserted in the recesses 316 respectively. At that time, between the u shaped copper tabs 23 and the n shaped recesses, rooms will be given for placement of the fuses 80 respectively. Next, the cover 34 is placed over the insert holder 31 with the slot 343 on its back side just fitted with the waterproof partition 312 of the insert holder 31. Then, the insert holder 31' together with the cover 34 can be placed from the exposed opening of the housing 32 into the housing. While the key 341 on the cover 34 is just fitted in the sliding slot 323 of the insert holder 32, the lower extension of the partition 312 will be inserted in the guide slot 324 in the housing 32. Finally, the insert holder 31 may be pushed in position in the housing 32.

Figure 6:
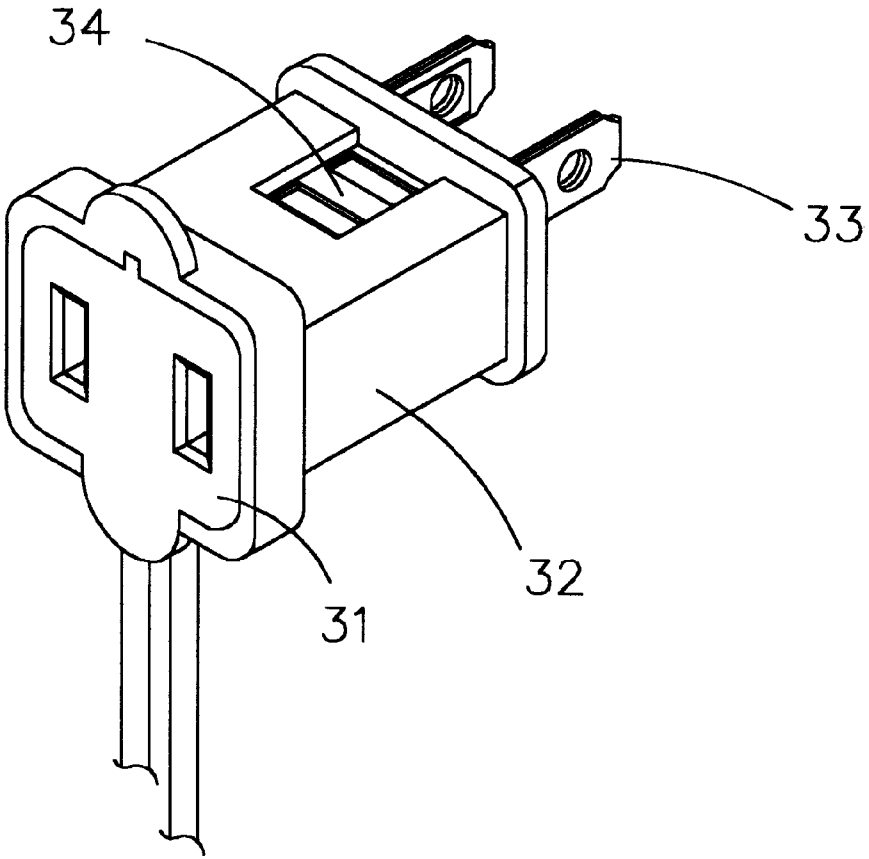
FIG. 6 is a schematic assembled view of the present invention.

When the power cable 20 is placed in the insert holder 31, its outer insulators rest against the ribs 319 in the cord profiled grooves 318 respectively. When the housing 32 is placed on the insert holder, the power cord 20 in the cord profiled grooves 318 will be pushed against the ribs 326 in the cord profiled grooves 327 at the bottom gap 325 of the housing 32 (as shown in FIG. 5) so that the power cable 20 is firmly clamped between the ribs 319 and 326, to obtain a socket adapter assembly, as shown in FIG. 6.

Referring to FIG. 4, the insert holder 31 has extensions of the waterproof partition 312 out of its upper, lower and rear side. These extensions are inserted in the guide slot 324 in the housing 32, the slot 60 and the slot 343 of the cover 34 respectively. Thus, the two power poles of the power cable 20 will be separated positively without contacting each other to cause a short circuit even if a poor connection of the power cable 20 with the copper tabs 23 or poor insulation occurs. Therefore, the potential risk of a short circuit is able to be removed completely. Additionally, the key 313 of the insert holder 31 has its extension integrated with the waterproof partition 312. Thus, when the insert holder 31 is placed into the housing 32, the cords of the power cable 20 can be separated completely. Meanwhile, the outer insulators of the power cable 20 are clamped by the ribs 319 in the insert holder 31 and the ribs 326 in the housing 32 so that the power cable 20 will be firmly fixed without loosening or removal of the power cable 20 due to an eventual foreign force. Besides, the profiled design of the cord grooves 318 and 327 and being clamped between the ribs 319 and 326 gives a good waterproof function. Since the power cable 20 is placed between the insert holder 31 and the housing 32 with the outer insulators of the power cable 20 being clamped by the ribs 319 and 326, and the lower key 313 of the insert holder 31 is fitted in the key-way 3271 in the housing 32, an airtight design is provided, and a secure connection, shock resistance and waterproof function can be achieved. The embodiment mentioned above is only abetter example to embody the present invention, and can not restrict the range of embodiment of the present invention to it; i.e. any modification or change made based on the present invention shall be considered to be within coverage of the present invention.

What is claimed is:

1. A waterproof socket adapter, comprising:

an insert holder having a waterproof partition and a key arranged therein, the key having a vertical extension integrated with the waterproof partition, said insert holder having pinholes on a front side thereof, and cord profiled grooves with ribs in the grooves provided behind and between the pinholes; leaf conductors and fuses received within said insert holder;

a cover having a key;

a housing having an internal sliding slot for receiving the key on the cover and having an internal guide slot for receiving the waterproof partition, and having a front key-way for engaging the vertical extension of the key of the insert holder, a front side of said housing having a bottom gap, and a vertical wall within the bottom gap having cord profiled grooves, the cord profiled grooves having a plurality of ribs arranged therein;

a power cable having two cords, the two cords being positively separated when the insert holder and the housing are assembled together, the cords having outer insulators clamped by the ribs both in the insert holder and in the housing; conductive tabs connected with the power cable, whereby when said insert holder is assembled to said housing, said power cable is firmly fixed by the ribs, thereby providing an airtight and waterproof configuration, and providing a secure and shock resistant connection.

2. The waterproof socket adapter recited in claim 1, wherein the waterproof partition has upper, lower and rear extensions.

3. The waterproof socket adapter recited in claim 1, wherein the key of the insert holder extends inwards and downwards and is integrated with the waterproof partition for separating the two cords of the power cable.

4. The waterproof socket adapter recited in claim 1, wherein said housing has a window arranged on a top side thereof to match the cover.

5. The waterproof socket adapter recited in claim 1, wherein said housing has a slot provided in an internal rear wall thereof for receiving the waterproof partition of the insert holder.

6. The waterproof socket adapter recited in claim 1, wherein the vertical wall within the bottom gap has a key-way for receiving a lower portion of the key of the insert holder.

7. The waterproof socket adapter recited in claim 1, wherein said housing has a blind rear wall in which a receptacle and recesses are arranged.

8. The waterproof socket adapter recited in claim 7, wherein the receptacle in said housing has two slots provided on a top side thereof.

9. The waterproof socket adapter recited in claim 8, wherein said cover has ribs inserted in the slots of the receptacle in the housing to form a waterproof assembly.

10. The waterproof socket adapter recited in claim 1, wherein, each leaf conductor has an n-shaped projection having a corresponding arched recess for increasing a contact area of the leaf conductor with the fuse.

11. The waterproof socket adapter recited in claim 1, wherein said conductive tabs are U-shaped.

* * * * *